US008031216B2

(12) United States Patent
Osawa et al.

(10) Patent No.: US 8,031,216 B2
(45) Date of Patent: Oct. 4, 2011

(54) PRINTER WITH PLATEN ROLLER GUIDE ON THERMAL HEAD

(75) Inventors: Kohei Osawa, Suwa (JP); Akira Koyabu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 838 days.

(21) Appl. No.: 12/075,839

(22) Filed: Mar. 14, 2008

(65) Prior Publication Data

US 2008/0267682 A1 Oct. 30, 2008

(30) Foreign Application Priority Data

Mar. 15, 2007 (JP) ..... 2007-066348

(51) Int. Cl.
*B41J 2/335* (2006.01)

(52) U.S. Cl. ..... 347/205; 400/649

(58) Field of Classification Search ..... 400/120.16, 400/649; 347/197, 205
See application file for complete search history.

(56) References Cited

U.S. PATENT DOCUMENTS

| | | | | |
|---|---|---|---|---|
| 6,876,467 | B1 * | 4/2005 | Yamaguchi | 358/1.9 |
| 2003/0118390 | A1 * | 6/2003 | Yamada et al. | 400/703 |
| 2004/0067088 | A1 * | 4/2004 | Kline | 400/615.2 |
| 2006/0280540 | A1 * | 12/2006 | Han | 400/120.16 |
| 2007/0267146 | A1 * | 11/2007 | Vigunas et al. | 156/443 |

FOREIGN PATENT DOCUMENTS

| | | | |
|---|---|---|---|
| JP | 10147023 A | * | 6/1998 |
| JP | 2001-158117 | | 6/2001 |
| JP | 2001-322304 | | 11/2001 |
| JP | 2002019218 A | * | 1/2002 |
| JP | 2004-098699 | | 4/2004 |
| JP | 2004314481 A | * | 11/2004 |
| JP | 2005-212139 | | 8/2005 |

* cited by examiner

*Primary Examiner* — Daniel J Colilla
(74) *Attorney, Agent, or Firm* — Nutter McClennen & Fish LLP; John P. Penny, Jr.; Michael P. Visconti, III

(57) ABSTRACT

A printer avoids scratching or damaging the platen and print defects caused by adhesive. The printer 1 prints to thermal paper S that has an adhesive area 150 formed on one side with the edges of the paper adhesive-free, and color layers formed on the other side of the paper. The thermal paper S is wound sequentially into a roll so that the other side is on the outside without applying a liner protecting the adhesive area 150 on the one side. The printer 1 has a platen 18, a heating element unit 43, and a guide incline 45. The platen 18 is disposed to a main cover, rotates in the thermal paper S transportation direction, and applies pressure to the thermal paper S from the one side. The heating element unit 43 selectively heats the other side of the paper. The guide incline 45 guides the thermal paper S in a prescribed direction without contacting the area on the back of the adhesive area 150 on the other side of the thermal paper S after the thermal paper S passes the heating element unit 43, and guides the platen 18 to a prescribed position so that the platen 18 does not contact the heating element unit 43 when the main cover is closed.

8 Claims, 7 Drawing Sheets

PRINTER WITH PLATEN ROLLER GUIDE ON THERMAL HEAD

BACKGROUND OF THE INVENTION

1. Field of Invention

The present invention relates to a printer that prints by selectively heating thermal paper that reacts to heat energy.

2. Description of Related Art

Thermal printers are one type of printer known from the literature. Thermal printers print using a direct thermal printing method that prints to thermosensitive paper (commonly called "thermal paper") as a result of the print head, which has small heating elements to which an electrical current is selectively applied arranged in a line, selectively fusing the color layers of the thermal paper, causing the heated dot to change to a particular color. As taught in Japanese Unexamined Patent Appl. Pub. JP-A-2004-98699 and Japanese Unexamined Patent Appl. Pub. JP-A-2001-322304, the thermal print head that prints by this direct thermal method has a pressure mechanism that urges the print head towards an opposing platen disposed to a heat radiation plate. The thermal paper is inserted between the thermal head and the platen, and is selectively heated while pressure is applied by the pressure mechanism to selectively fuse the color layers of the paper to print. The printed thermal paper is then conveyed outside the printer with the side of the paper having the color layers in contact with a guide member disposed to the heat radiation plate downstream from the thermal head.

Label paper is one type of thermal paper that is printed by such thermal printers. Such label paper has an adhesive coating on the opposite side as the side containing the color layers, and a web (liner) that protects the adhesive area. Information is printed in the thermosensitive area of the label paper, and the labels can then be peeled from the liner and applied to some other object.

If the platen is disposed to the main cover of the thermal printer, a mechanism for preventing the cover from hitting and damaging the thermal head when the cover is closed is needed. So that pressure can be accurately applied to the thermal paper when printing, the platen opposing the thermal head must be protected from scratching and damage particularly in the middle area where printing becomes lighter. This is commonly accomplished by providing a guide member to guide the platen to a prescribed position. However, as the cover is repeatedly opened and closed and repeatedly contacts the guide member, the platen gets scratched and damaged so that pressure is not accurately applied to the platen, contact between the platen and thermal paper therefore deteriorates, and print defects occur.

A newer type of thermal paper is linerless label paper that does not have a liner protecting the adhesive area. However, because linerless label paper is wound into a roll and the adhesive side of the paper is necessarily wound against the color layer side of the paper, a small amount of the adhesive from the adhesive side inevitably adheres to the surface of the color layer side behind the adhesive side. When the surface containing the color layers of the printed linerless label paper then passes over the guide member, the adhesive sticking to the color layer surface transfers to the guide member. As the adhesive accumulates, smooth transportation of the thermal paper is impeded, contact between the thermal head and the thermal paper deteriorates, and print defects occur.

SUMMARY OF THE INVENTION

A printer according to the present invention has a roller unit that is rotatably supported on a main cover, rotates in a thermal paper feeding direction, and applies pressure to one side of the thermal paper, a heating element unit that is disposed opposite the roller unit with the thermal paper therebetween, and selectively heats the color layers of the thermal paper, and a guide unit that guides the roller unit in a prescribed direction when the main cover closes. The guide unit has a contact unit that contacts both end parts of the roller unit.

By having a contact unit rendered so that the guide unit contacts both end parts of the roller unit when the main cover closes, the middle part of the roller unit does not contact the guide unit, and is guided to a prescribed position without being scratched or damaged.

A printer according to another aspect of the invention prints to thermal paper that has an adhesive side formed on one surface with a non-adhesive area formed along both edge portions and an adhesive area therebetween, and a color layer side on which color layers are formed, and is wound sequentially into a roll so that the color layer side is to the outside without a liner protecting the adhesive area on the adhesive side. A roller unit applies pressure to one side of the thermal paper while advancing the paper. A heating element unit is disposed opposite the roller unit with the thermal paper therebetween, and selectively heats the other side of the thermal paper to selectively fuse the color layers to print. The guide unit guides the thermal paper in a prescribed direction by contacting the area that is not behind the adhesive area on the color layer side of the thermal paper that is heated and conveyed.

This aspect of the invention guides the printed thermal paper in the direction in which it is to travel from the other side of the paper without touching the area on this other side of the paper that is on the back of the adhesive area. In addition not touching to the adhesive area where the adhesive is coated on the one side of the paper, the guide unit therefore also does not contact the area on the other side of the thermal paper to which some adhesive from the one side is transferred as a result of the thermal paper being wound in a roll. As a result, problems caused by adhesive on the guide unit, such as the direction in which the paper is guided being skewed, poor contact between the heating element unit and the thermal paper, and print defects caused by such poor contact, can be avoided.

In a printer according to another aspect of the invention, the guide unit preferably has an inclined part that causes the roller unit to slide without contacting the heating element unit to a position opposite the heating element unit, and the contact unit is disposed at an end part of the inclined part.

The roller unit thus slides and is guided to a position opposite the heating element unit without colliding with the heating element unit, and damage to the heating element unit caused by collision with the roller unit can be avoided.

Yet further preferably, the contact unit has curved surfaces that contact the other side of the thermal paper and the end parts of the roller unit.

Because the contact unit contacts the thermal paper and the roller unit with a curved surface, the thermal paper and roller unit can be guided without creasing or marring.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of the present invention is described below with reference to the accompanying figures.

Figure 1:
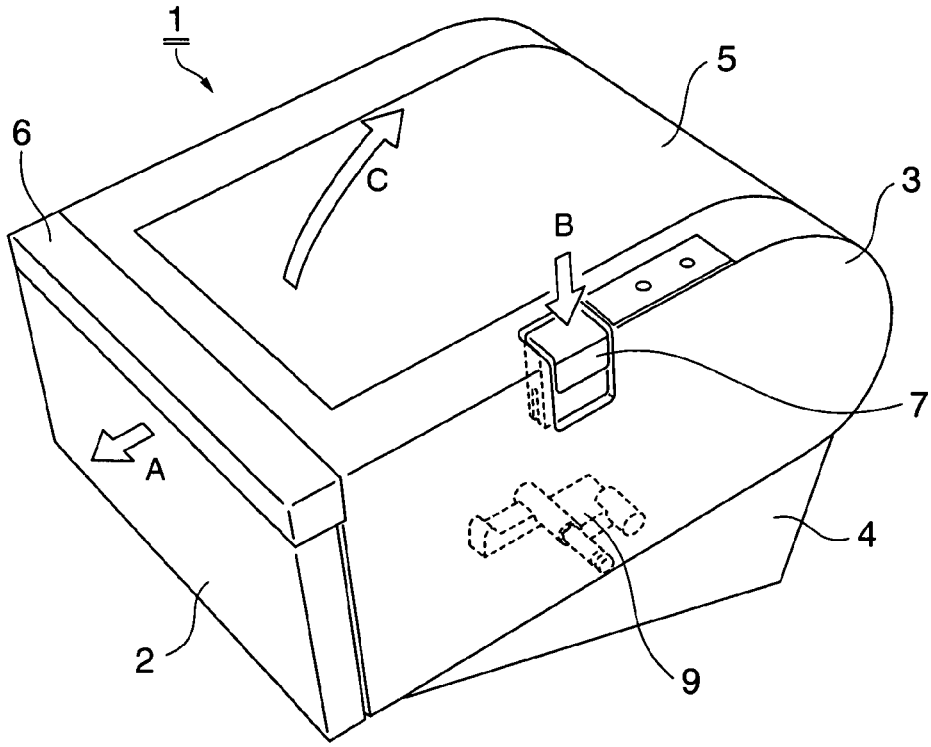
FIG. 1 is an oblique view showing the appearance of a printer according to a preferred embodiment of the invention.

FIG. 1 is an oblique view showing the appearance of a printer 1 according to a preferred embodiment of the invention. The printer 1 is a thermal printer that is used as a receipt printer in a POS system, for example. The printer 1 uses thermal paper S that is wound in a roll (see FIG. 7), and has a print mechanism unit 8 (FIG. 2) for printing information on the thermal paper S, a paper cutting unit for cutting the printed thermal paper S, and a roll paper compartment for storing the thermal paper S.

The print mechanism unit 8 (FIG. 2) is attached to a bottom case 4 made of plastic, the side and back portions are covered by a top case 3, and the front portion is covered by a panel 2. A paper cutter unit is disposed at the top of the panel 2. The paper cutter unit is covered by a cutter cover 6, and the cutter cover 6 can be slid out in the direction of arrow A.

An open button 7 that drives an internal cover opening lever 9 to rotate an internal cover frame 10 (FIG. 2) in order to remove the thermal paper S is disposed at one side of the top case 3. This cover frame 10 (FIG. 2) is connected to a top cover 5. When the open button 7 is pressed in the direction of arrow B, the cover opening lever 9 rotates clockwise and a lock mechanism disengages so that the top cover 5 can open in the direction of arrow C and the roll paper compartment 17 (FIG. 2) is exposed.

Figure 7:
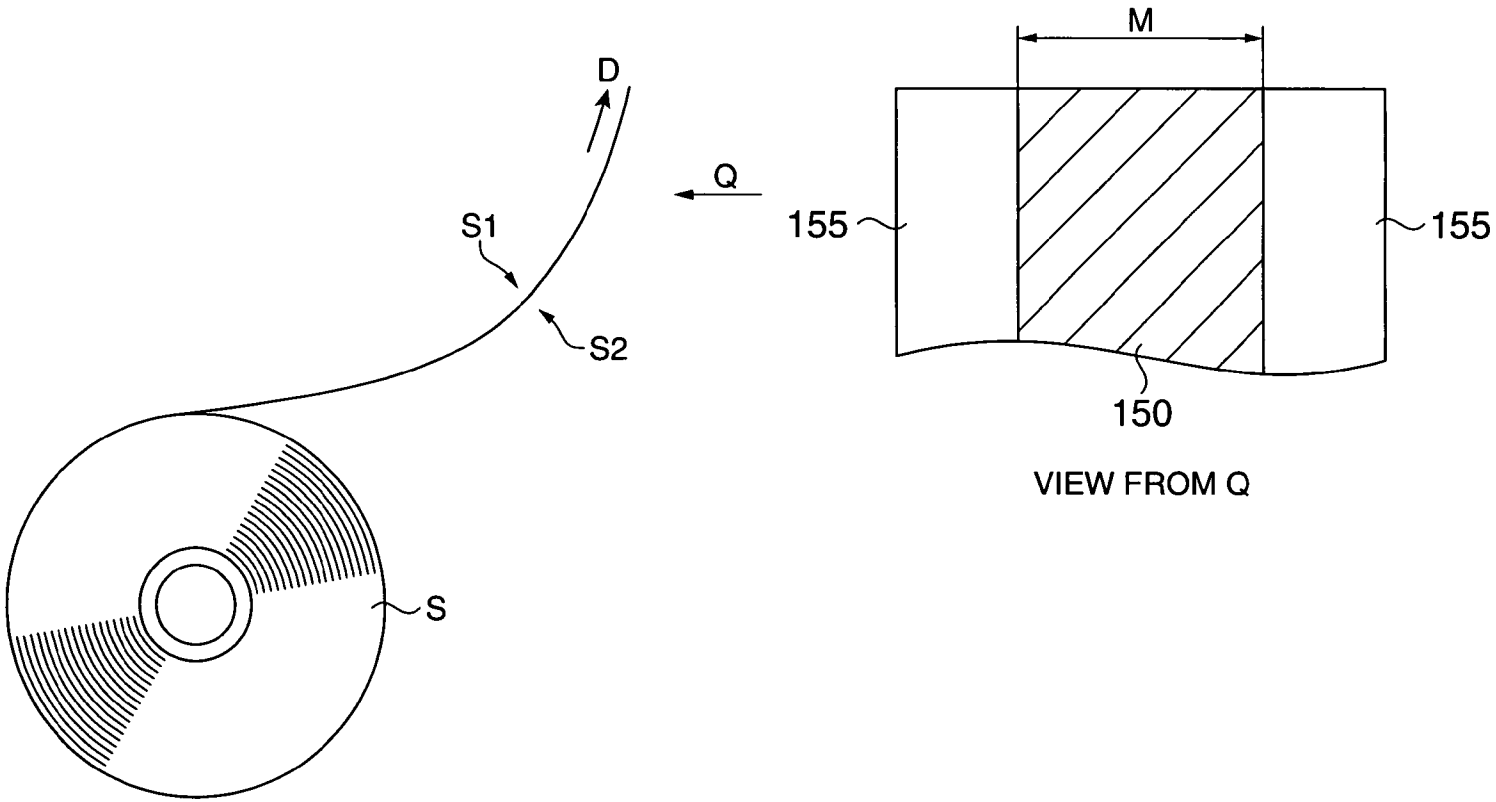
FIG. 7 describes a roller of linerless label paper.

The thermal paper S used in this embodiment of the invention is linerless label paper that has an adhesive area on the opposite side as the printing surface, and is wound into a roll with the printing surface to the outside without having a web (liner) protecting the adhesive area. As shown in FIG. 7, the thermal paper S has an adhesive area 150 of a prescribed width W formed substantially in the center of the inside surface S2 of the roll, and a nonadhesive area 155 from along each edge of the inside surface S2. A color layer having a plurality of colorants held separated by a binder is formed on the outside surface S1 of the roll. As described above, a small amount of adhesive from the adhesive area 150 adheres to the outside surface S1 opposite the adhesive area 150 of this thermal paper S.

Figure 2:
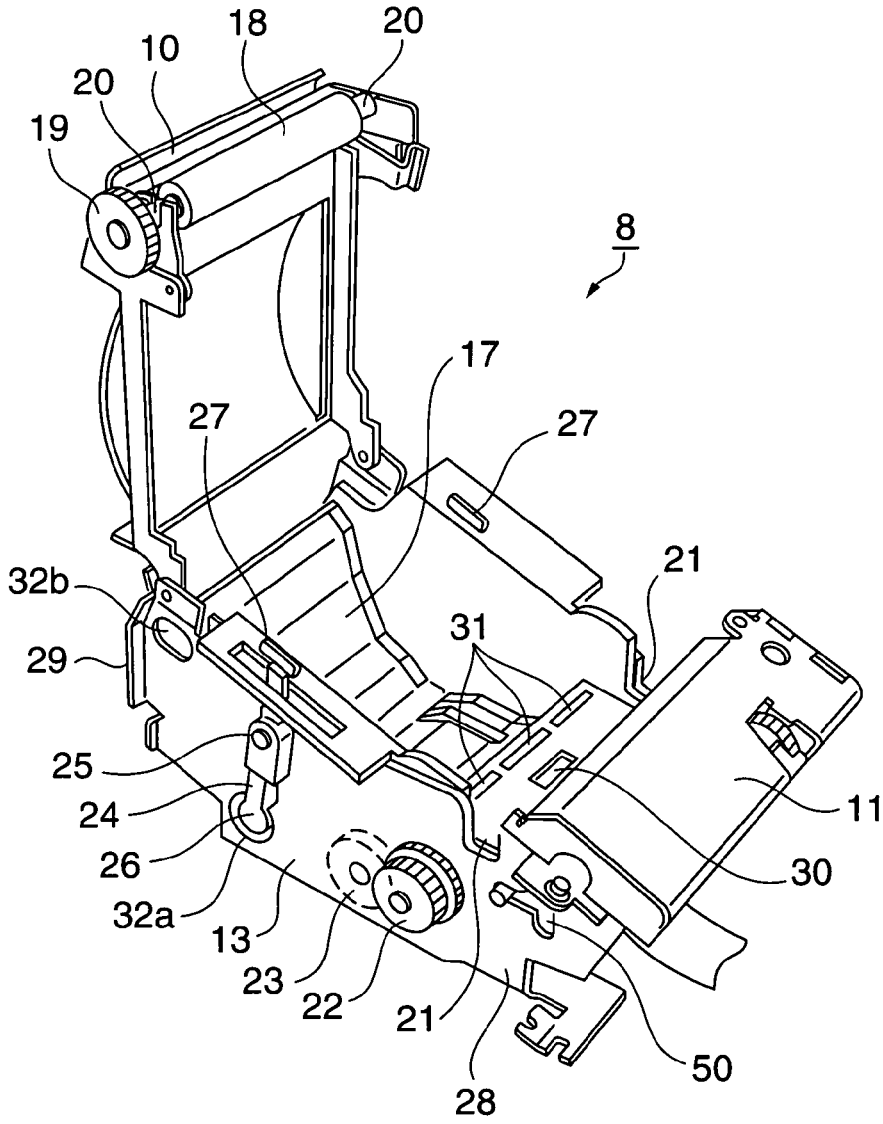
FIG. 2 is an oblique view of the print mechanism unit when the cover frame is open.
Figure 3:
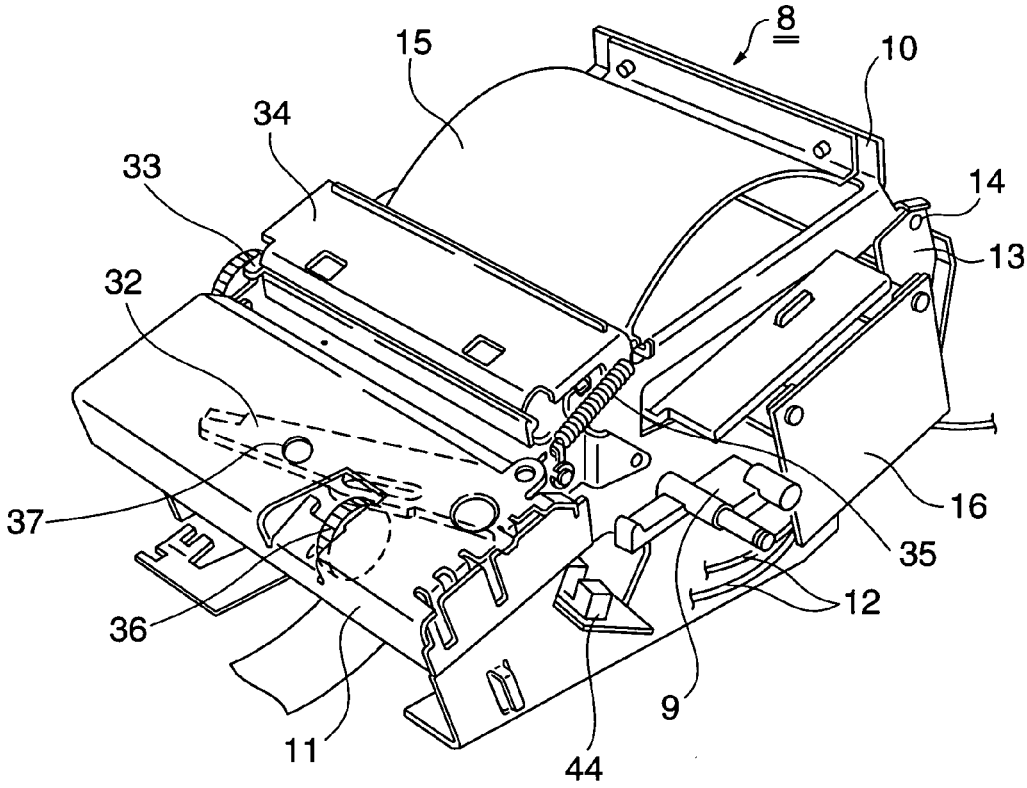
FIG. 3 is an oblique view of the print mechanism unit when the cover frame is closed.

FIG. 2 and FIG. 3 are oblique views of the print mechanism unit 8, FIG. 2 being an oblique view of the print mechanism unit 8 when the cover frame 10 is open, and FIG. 3 being an oblique view of the print mechanism unit 8 when the cover frame 10 is closed.

The print mechanism unit 8 has a cover frame 10 that opens and closes freely to the top of a main frame 13 that is typically metal, and an automatic paper cutter unit 11 that houses a movable knife 32 and a drive means for the movable knife. When the thermal paper S is not cut, the movable knife 32 is stored inside the automatic paper cutter unit 11 and the movable knife 32 is not exposed. When thus positioned, the movable knife 32 is said to be in the standby position.

A fixed knife 33 that crosses the movable knife 32 with a scissor action is disposed to the cover frame 10 opposite the automatic paper cutter unit 11. A blade shutter 34 is disposed above the fixed knife 33. The blade shutter 34 is urged by a shutter spring 35 in the direction covering the cutting edge of the fixed knife 33, but when the cover frame 10 is closed as shown in FIG. 3, part of the blade shutter 34 contacts an engaging part disposed to the main frame 13 so that the blade shutter 34 is lifted slightly open. The cutting edge of the fixed knife 33 is thus exposed so that the movable knife 32 can move across the fixed knife 33 with a scissor action to cut the paper.

The cover frame 10 is attached to pivot, that is, open and close freely, on support pins 14 provided at the top part on both sides of the main frame 13. A cover part 15 disposed to the cover frame 10 is curved so that the cover part 15 does not contact the thermal paper S when the cover frame 10 is closed. When the orientation of the printer installation is changed, this cover part 15 also functions as a holding member that receives the thermal paper S.

A cover detector 44 that detects if the cover frame 10 is closed is disposed on the right side of the main frame 13. This cover detector 44 is a transmission type photodetector, and detects whether or not the cover frame 10 is closed correctly based on whether the light beam from the detector is interrupted by a part of the cover frame 10.

A near-end detector 24 and a paper detector 30 described below are also provided in addition to this cover detector 44. Leads 12 from these detectors, the automatic paper cutter unit 11, and a paper transportation motor 23 described below are connected to a relay board 16 attached to the right side of the main frame 13. The relay board 16 and a main circuit board (not shown in the figure) that controls the printer 1 are connected by a flat flexible cable, for example.

FIG. 2 is an oblique view from the left side of the print mechanism unit 8, and shows the cover frame 10 open and the blade shutter 34 covering the fixed knife 33. This arrangement is to prevent the operator from touching and being cut by the fixed knife 33 when the cover frame 10 is open. The movable knife 32 is housed inside the automatic paper cutter unit 11 and does not present a safety problem.

A plastic roll paper compartment 17 is disposed inside the open cover frame 10. The paper detector 30 for detecting if paper is present is disposed to the roll paper compartment 17. The paper detector 30 is a reflection type photodetector, and a group of holes 31 is disposed on the upstream side of the paper detector 30. The holes 31 allow foreign matter and chaff clinging to the thermal paper S to drop out so that the paper dust or other foreign matter does not interfere with detector operation. Slots 27 for engaging the right and left side panels of the main frame 13 are also rendered in the roll paper compartment 17. When these slots 27 engage the right and left side panels of the main frame 13, the widthwise position of the roll paper compartment 17 is fixed and the inside of the roll paper compartment is held at a width suitable to the thermal paper S.

A platen 18, which is a roller unit having a cylindrical rubber roller, is supported rotatably on the cover frame 10 by a platen shaft 20. A platen gear 19 is press fit to one end of the platen 18. A groove part 21 is rendered to the main frame 13 so that when the cover frame 10 closes, the platen shaft 20 is guided by a guide incline 45 of the heat radiation plate 47 (FIG. 4) and then contacts the groove part 21, and the platen 18 is positioned in a prescribed position. Pressure from the thermal head 39 (FIG. 4) on the platen 18 works to push down on the cover frame 10 and determine the position of the platen 18. The platen gear 19 and paper transportation transfer gear 22 also mesh and power is transmitted from the paper transportation motor 23 to the platen 18.

The near-end detector 24 for detecting if the thermal paper S is near the end of the roll is disposed freely rotatably on a support pin 25 on the left side of the main frame 13. This arrangement enables the near-end detector 24 to be optimally positioned according to the orientation angle of the printer. For example, when the printer is used with the bottom 28 of the cover frame 10 down as shown in FIG. 2, the actuator 26 of the near-end detector 24 is fixed inside a hole 32*a* rendered in the cover frame 10. When the printer is used with the back 29 of the cover frame 10 down, however, the actuator 26 is fixed in position in a separate hole 32*b*. A support channel unit 50 that supports the thermal head 39 (FIG. 4) and the head pressure plate 41 (FIG. 4) is rendered at the left and right sides of the main frame 13.

Figure 4:
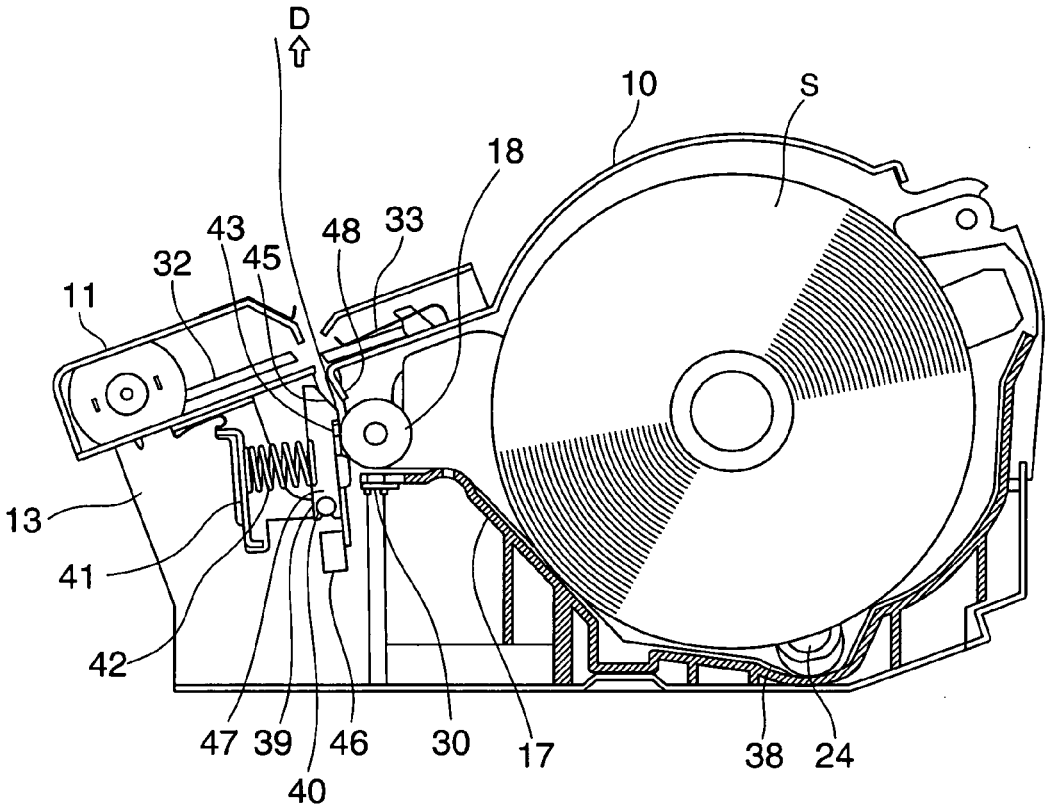
FIG. 4 is a side section view of the print mechanism unit.

FIG. 4 is a side section view of the print mechanism unit 8, and shows the thermal paper S roll paper compartment 17 held in the roll paper compartment 17 with the leading end delivered in the discharge direction (D). FIG. 4 shows the thermal paper S when the diameter is large. As the paper is advanced and the diameter of the thermal paper S becomes small enough, the thermal paper S drops into the recess 38 and the near-end detector 24 thus detects that the roll diameter of the thermal paper S has become a certain small size.

Figure 5:
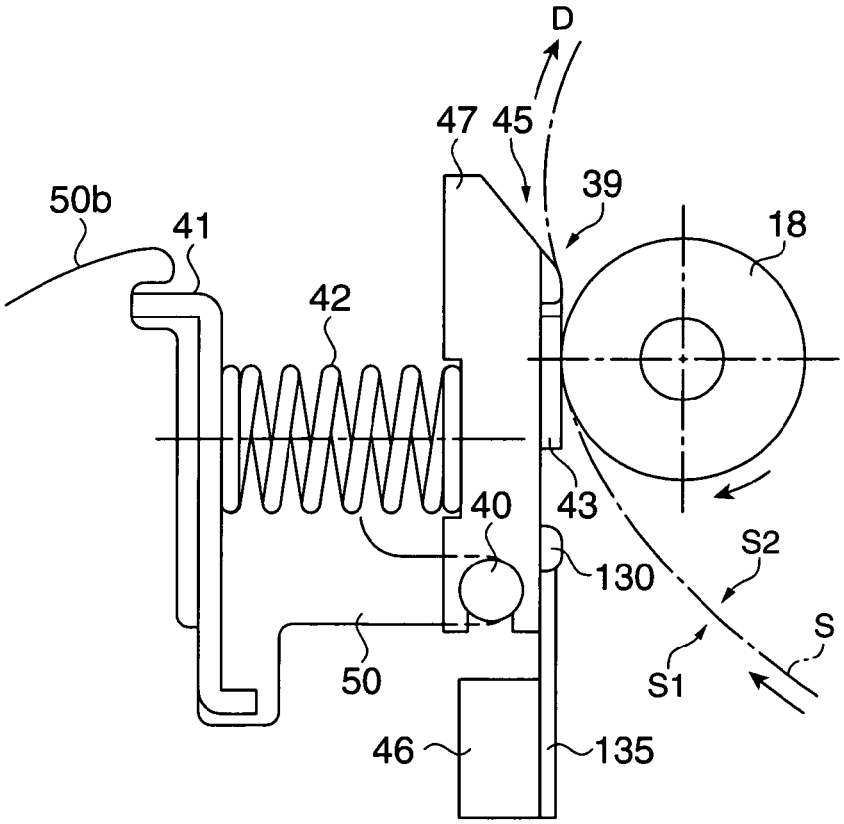
FIG. 5 is a section view showing the thermal head in detail.

FIG. 5 is a section view showing the thermal head 39 in detail. As shown in this figure, a head support pin 40 is disposed on both sides of the thermal head 39, and the head support pins 40 are supported on a part of the support channel unit 50 disposed to the main frame 13. The heating element unit 43 disposed to the thermal head 39 is urged by a spring 42 toward the platen 18. The spring 42 is affixed to the head pressure plate 41, and the head pressure plate 41 is supported by the support channel unit 50*b* disposed to the main frame 13. With this arrangement the thermal paper S is held between the platen 18 and the heating element unit 43 with the platen 18 pressing the thermal paper S from the inside surface S2 side to the thermal head 39, and the heating element unit 43 of the thermal head 39 opposite the platen 18 pressed against the outside surface S1 of the thermal paper S.

Figure 6B:
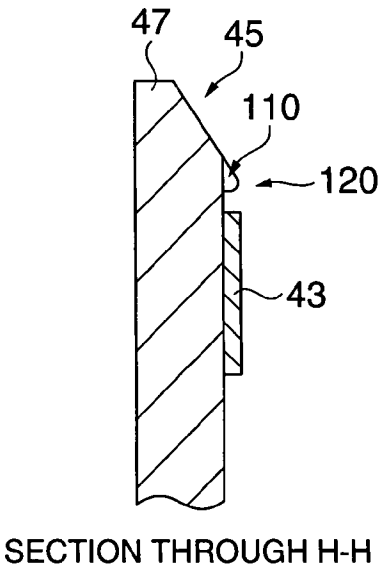
FIG. 6B is a section view of the middle part of the thermal head.
Figure 6A:
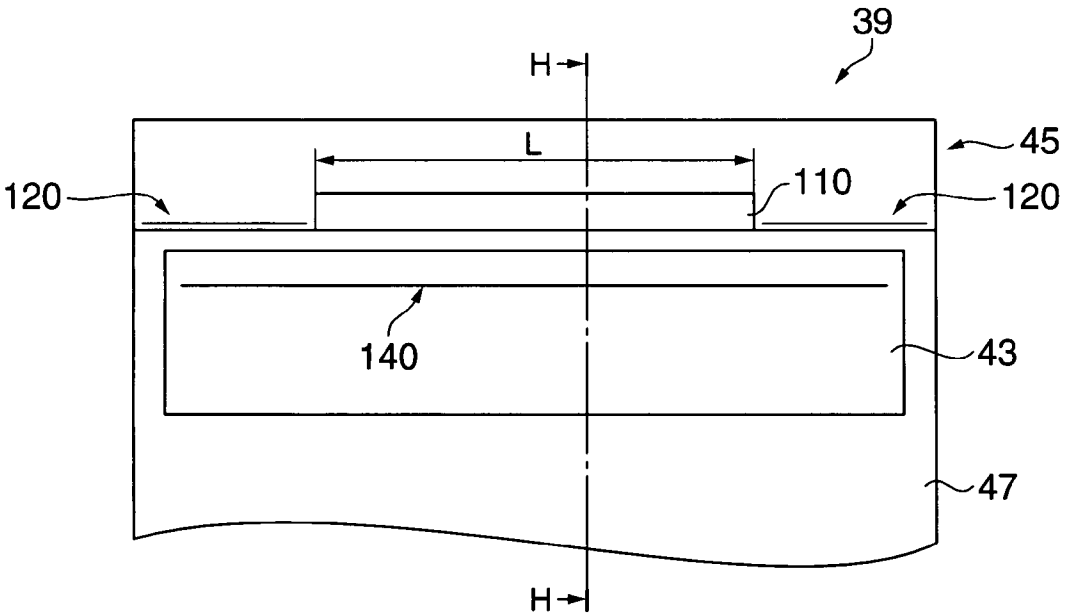
FIG. 6A is a plan view from the platen side of the heating unit of the thermal head.

FIG. 6A is a plan view from the platen 18 side of the heating element unit 43 area of the thermal head 39, and FIG. 6B is a section view through approximately the middle of FIG. 6A. The thermal head 39 uses the heat radiation plate 47 as a base, and a guide incline 45 is formed as a guide unit on one end part on the side of the heat radiation plate 47 facing the platen 18. When the cover frame 10 closes, the platen 18 slides along the guide incline 45 and is guided thereby to a prescribed position. The slope of the guide incline 45 is an angle preventing the platen 18 from colliding with the heating element unit 43. This guide unit is also disposed so that the platen does not strike the end part of the heating element unit 43 and the heating element unit is not damaged. As also shown in FIG. 6B, a notched part 110 of a prescribed width L is disposed and in this embodiment of the invention a surface of substantially the same thickness as the flat part of the heat radiation plate 47 is formed in the center at the end where the platen 18 slides across the guide incline 45. The prescribed width L is set to be longer than the width M of the adhesive area 150 of the thermal paper S. The inclined face of the guide incline 45 is set at approximately the same height as the heating element unit 43 disposed proximally to the guide incline 45.

The heating element unit 43 is described next with reference to FIG. 5 and FIG. 6. The heating element unit 43 is formed on a base substrate made from an alumina ceramic, for example, and though not shown in the figures, an underglaze layer, metal electrodes, a common electrode, and a protective film are formed in layers on the substrate surface. A linear heating resistor 140 that converts an applied current to heat is embedded protected by the protective film along the length of the heating element unit 43. This heating resistor 140 has hundreds of fine heating elements arrayed in a line. When the heating elements are selectively energized, only the energized heating elements instantaneously emit heat. When the heating element is de-energized, the heat is instantly dissipated by the heat radiation plate 47. The heating resistor 140 is embedded substantially at the point of tangency between the platen 18 and the thermal head 39.

An epoxy molding 130 containing a sealed driver chip for selectively energizing the heating resistor 140 is disposed near the other end of the heat radiation plate 47 as the surface where the heat radiation plate 47 faces the platen 18, and a glass epoxy circuit board 135 wired to the epoxy molding 130 extends beyond this other end. A connector 46 connected by a flat flexible cable, for example, to the main circuit board (not shown in the figure) that controls the printer 1 is disposed to the end part of the glass epoxy circuit board 135.

The thermal paper S is thus sequentially advanced in the discharge direction (D) by the platen 18 while pressed against the heating resistor 140 of the heating element unit 43. As the paper advances, the heating resistor 140 emits heat from the heating elements in response to signals sent from the main circuit board (not shown in the figure) through the connector 46. The thermal paper S is thus selectively heated across the width so that the color layers formed on the outside surface S1 are selectively fused as the thermal paper S advances sequentially lengthwise and information is printed to the thermal paper S according to the applied signals. After passing the heating element unit 43, both edge parts on the outside surface S1 of the thermal paper S contact the distal end parts 120 formed with a curve at the ends of the guide incline 45 so that the thermal paper S is guided upward without curling, and are guided into the paper cutter unit by the guide portions 48 disposed to the cover frame 10.

Because a notched part 110 is disposed to the guide incline 45, the part of the outside surface S1 on the back of the adhesive area 150 formed in the middle of the inside surface S2 is guided upward without touching the guide incline 45. More particularly, adhesive material sticking to the area of the outside surface S1 behind the adhesive area 150 does not stick to the guide incline 45, and the paper is discharged with the adhesive remaining on the outside surface S1. The thermal paper S guided to the paper cutter unit passes between the movable knife 32 and fixed knife 33, and is discharged from the printer 1.

The invention is described above with reference to a preferred embodiment thereof, but is not limited to this embodiment and can be varied in many ways, including the variations described below.

(1) The heat radiation plate 47 can be a thin plate that is bent to form the guide incline 45. The notched part 110 is not limited to a flat surface, and can be any shape that does not contact the area of the outside surface S1 behind the adhesive area 150.

(2) The width L of the notched part 110 can be adjusted according to the width M of the adhesive area 150 of the thermal paper S.

(3) The platen 18 is not limited to being supported on the top cover 5. For example, the thermal head could be disposed to the top cover 5 and the platen could be disposed to the main frame.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer, comprising:

a main cover configured to be rotated between an open position and a closed position;

a roller that is rotatably supported on the main cover and is configured to transport and apply pressure to thermal paper;

a heating element positioned and configured to selectively heat the thermal paper; and a guide unit configured to guide the roller upon contact of the guide unit by the roller when the main cover is being moved from its open position to its closed position, the guide unit including a plurality of separate contacts, each of which is configured to contact a corresponding segment of the roller at least when the main cover approaches the closed position;

wherein one of the plurality of contacts is formed at one side of the guide unit and another is formed at the opposite side of the guide unit relative to a direction of travel of the roller along the guide unit;

the printer is configured to print by selectively fusing color layers of thermal paper, the thermal paper having an adhesive side formed on one surface thereof, the adhesive side having a non-adhesive area formed along first and second edge portions thereof and an adhesive area formed between the first and second edge portions, the thermal paper further having a color layer side on which color layers are formed, the thermal paper being wound sequentially into a roll such that the color layer side is to the outside of the roll without a liner protecting the adhesive area on the adhesive side; and the guide unit guides the thermal paper in a prescribed direction by only contacting areas of the color layer side that oppose the non-adhesive area of the adhesive side.

2. The printer as described in claim 1, wherein the guide unit has an incline that causes the roller to move along the guide unit to a position opposing the heating element without contacting an end portion of the heating element.

3. The printer as described in claim 2, wherein each of the plurality of contacts has a curved surface.

4. The printer described in claim 1, wherein:

the guide unit has a contact unit that contacts the areas of the color layer side that oppose the non-adhesive area of the adhesive side.

5. The printer described in claim 4, wherein:

the contact unit has curved surfaces that contact the areas of the color layer side that oppose the non-adhesive area of the adhesive side.

6. A printer, comprising:

a thermal head having a heating element;

a roller that is disposed to move toward and away from the heating element and is configured to rotate;

a guide unit that is disposed to guide the roller upon contact of the guide unit by the roller, the guide unit including a plurality of separate contacts, one of the plurality of separate contacts formed at one side of the guide unit and another of the plurality of separate contacts formed at the opposite side of the guide unit relative to a direction of travel of the roller along the guide unit, each of the plurality of separate contacts configured to contact a corresponding segment of the roller at least when a main cover to which the roller is coupled approaches a closed position, the guide unit further including at least one middle part between the plurality of separate contacts that is positioned to not contact the roller;

wherein the plurality of separate contacts guide paper in a prescribed direction.

7. A printer as described in claim 6, wherein the guide unit is formed at a position where it can protect at least an end portion of the heating element from contact with the roller.

8. The printer described in claim 7, wherein:

the printer is configured to print by selectively fusing color layers of thermal paper, the thermal paper having an adhesive side formed on one surface thereof, the adhesive side having a non-adhesive area formed along first and second edge portions thereof and an adhesive area formed between the first and second edge portions, the thermal paper further having a color layer side on which color layers are formed, the thermal paper being wound sequentially into a roll such that the color layer side is to the outside of the roll without a liner protecting the adhesive area on the adhesive side; and the guide unit guides the thermal paper in a prescribed direction by only contacting areas of the color layer side that oppose the non-adhesive area of the adhesive side.

* * * * *